United States Patent [19]

Dirkin

[11] Patent Number: 4,773,306

[45] Date of Patent: Sep. 27, 1988

[54] DUAL TANDEM COMPOSITE CYLINDER ASSEMBLY INCLUDING SEPARATELY FORMED CYLINDER BARRELS

[75] Inventor: William Dirkin, Portage, Mich.

[73] Assignee: Pneumo Abex Coporation, Boston, Mass.

[21] Appl. No.: 883,384

[22] Filed: Jul. 8, 1986

[51] Int. Cl.[4] ..... F01 7/00

[52] U.S. Cl. ..... 92/151; 92/169 R

[58] Field of Search ..... 92/146, 150, 151, 169 R, 92/170; 285/149, 175, 177, 368, 412; 403/43, 48, 118, 336, 338

[56] References Cited

U.S. PATENT DOCUMENTS

| | | | |
|---|---|---|---|
| 174,475 | 3/1876 | Carleton | 285/412 |
| 2,146,218 | 2/1939 | Kimmich et al. | 285/149 |
| 2,408,960 | 10/1946 | Stivason | 285/149 X |
| 3,783,620 | 1/1974 | Moe | 92/151 X |
| 3,884,127 | 5/1975 | Simmons | 92/151 |
| 4,236,736 | 12/1980 | Anderson | 285/175 X |
| 4,432,572 | 2/1984 | Thalmann | 285/412 |
| 4,449,446 | 5/1984 | Degnan et al. | 92/168 X |

FOREIGN PATENT DOCUMENTS

| | | | |
|---|---|---|---|
| 531180 | 8/1931 | Fed. Rep. of Germany | 285/149 |

*Primary Examiner*—Robert E. Garrett
*Assistant Examiner*—Mark A. Williamson
*Attorney, Agent, or Firm*—Renner, Otto, Boisselle & Sklar

[57] ABSTRACT

A dual tandem composite cylinder composite cylinder assembly including a pair of composite cylinder barrels in series, and a center dam connection between adjacent ends of the cylinder barrels formed by providing an interference between external ramps on the adjacent ends of the cylinder barrels and correspondingly sloping internal ramps on respective clamping rings and/or split spacers between the clamping rings and external ramps for clamping the external ramps against a center dam between the adjacent ends of the cylinder barrels. The clamping rings may be connected together by means of a plurality of bolts which, when pretensioned, force the clamping rings toward each other to cause a compression load to be applied at the ramp surfaces. Alternatively, a tensioning nut having internal threads of opposite hand in opposite ends of the nut in threaded engagement with the clamping rings may be used in place of the bolts to move the clamping rings toward each other.

20 Claims, 2 Drawing Sheets

FIG. 2
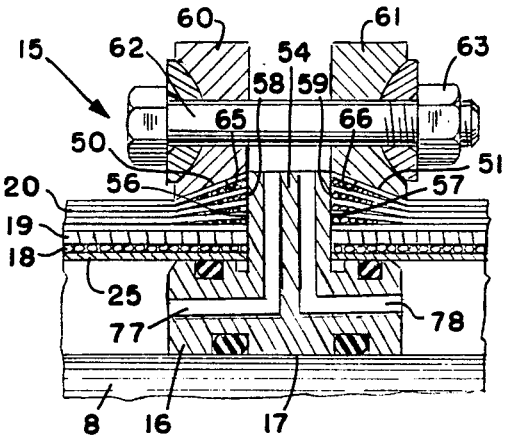
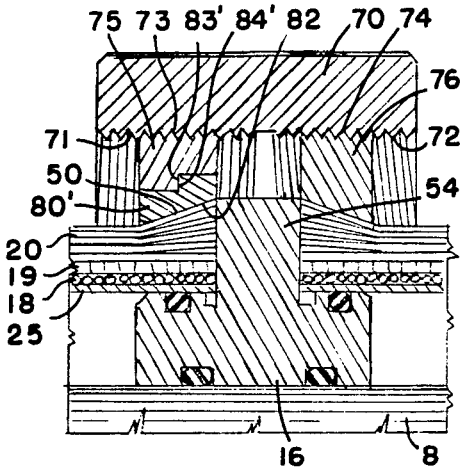
FIG. 5
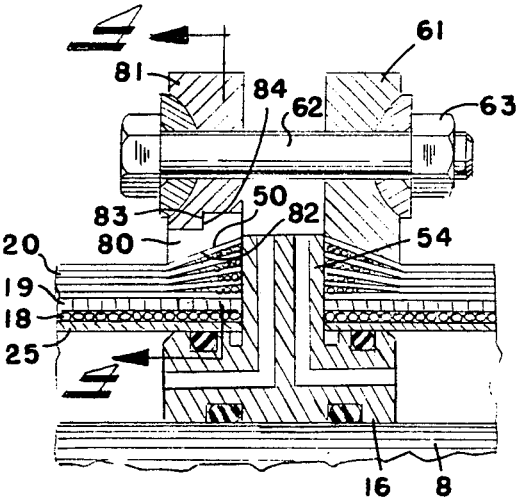
FIG. 3
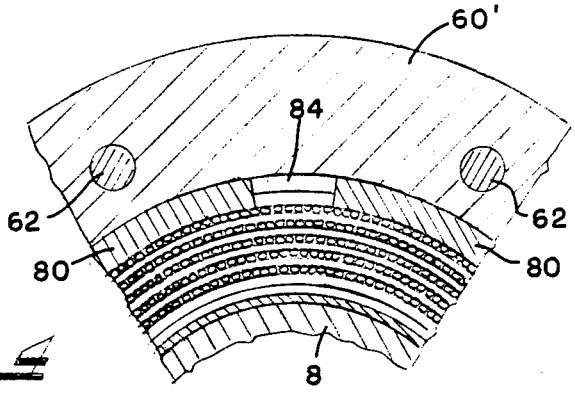
FIG. 4

DUAL TANDEM COMPOSITE CYLINDER ASSEMBLY INCLUDING SEPARATELY FORMED CYLINDER BARRELS

BACKGROUND OF THE INVENTION

This invention relates generally as indicated to a dual tandem composite cylinder assembly including a pair of fluid cylinders having separately formed cylinder barrels connected together at a center gland connection.

Dual tandem composite cylinder assemblies have particular application in flight controls for aircraft and similar type applications where system redundancy is important. Typically, such dual tandem cylinder assemblies include a pair of fluid cylinders in series having respective pistons connected to a common ram output rod for common movement therewith. In service, the two cylinders may be used in tandem, or independently, to extend or retract the rod, or to provide a compressive or tension load within the cylinders.

It is generally known from copending U.S. patent application Ser. No. 642,539, assigned to the same assignee as the present application, to utilize a directional composite cylinder construction for such a dual tandem cylinder assembly which provides a relatively light weight, low cost, envelope efficient design. However, the dual tandem composite cylinder assembly of such copending application includes a monolithic composite cylinder construction formed by longitudinal tension windings extending over substantially the entire length of both the head and rod end cylinders, which causes some assembly problems during manufacture.

SUMMARY OF THE INVENTION

With the foregoing in mind, it is a principal object of this invention to provide dual tandem composite cylinder assembly including separately formed rod and head end cylinder barrels connected together at a center dam connection.

In accordance with one aspect of the invention, the center dam connection is effected by providing an interference between external ramps on the adjacent ends of the head and rod end cylinder barrels and correspondingly sloping internal ramps on respective annular clamping rings surrounding the external ramps for clamping the external ramps against a center dam between the adjacent ends of the cylinder barrels.

Also in accordance with the invention, the external ramps at the adjacent ends of the cylinder barrels may be formed by interspersing circumferential or hoop stress windings between a plurality of layers of longitudinal tension windings in the walls of the respective cylinder barrels to displace the longitudinal tension fibers outward and add circumferential stiffness to the adjacent ends of the cylinder barrels.

In accordance with another aspect of the invention, a split spacer ring may be inserted between one or both external ramps at the adjacent ends of the cylinder barrels and the associated clamping rings to permit larger diameter clamping rings to be used to facilitate assembly of the clamping rings over the cylinder barrels from either end thereof.

In accordance with still another aspect of the invention, the annular clamping rings may be externally threaded for threaded engagement by a tension nut having threads of opposite hand engaging the respective clamping rings which may be indexed with pins to pretension the joint.

To the accomplishment of the foregoing and related ends, the invention, then, comprises the features hereinafter fully described and particularly pointed out in the claims, the following description and annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 2 is an enlarged fragmentary longitudinal section through the center dam connection between the adjacent ends of the separately formed cylinder barrels of the dual tandem composite cylinder assembly of FIG. 1;

FIG. 3 is a fragmentary longitudinal section similar to FIG. 2 but showing a modified form of center dam connection between the adjacent ends of the cylinder barrels;

FIG. 4 is an enlarged fragmentary transverse section through the center dam connection of FIG. 3, taken generally along the plane of the line 4—4 thereof; and FIG. 5 is a fragmentary longitudinal section showing still another form of center dam connection in accordance with this invention.

DETAILED DESCRIPTION OF THE PREFERRED EMBODIMENTS

Figure 1:
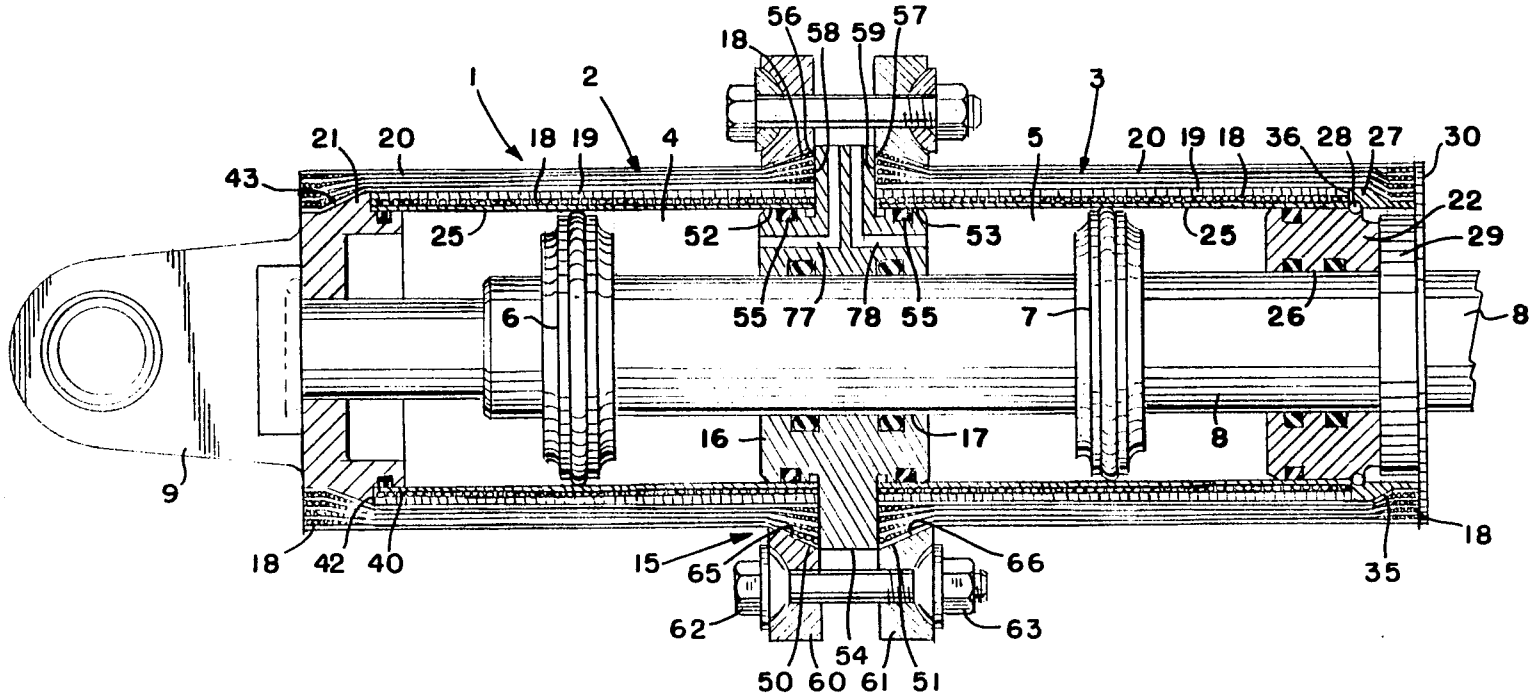
FIG. 1 is a fragmentary longitudinal section through one form of dual tandem composite cylinder assembly in accordance with this invention.

Referring now in detail to the drawings, and initially to FIG. 1, there is shown a preferred form of dual tandem composite cylinder assembly 1 in accordance with this invention, which generally comprises head and rod end cylinders 2, 3 containing respective hydraulic chambers 4, 5 in series and having respective pistons 6, 7 connected to a common ram output rod 8 for common movement therewith. In service, the two chambers 4, 5 may be used in tandem, or independently, to extend to retract the rod, or provide a compressive or tension load within the cylinders. The outboard end of the rod is adapted to be attached to a movable part to be actuated, whereas the inboard end of the head end cylinder 2 may be provided with a suitable mount 9 such as a clevis attachment or simple bearing connected thereto for attaching the cylinder assembly 1 to the stationary part of the device to be actuated.

As described in more detail hereafter, the cylinder barrels 2, 3 are separately constructed utilizing directional composites and subsequently connected together at a center dam connection 15, thus eliminating the assembly problems associated with a monolithic design in which one or more of the directional composites extend over substantially the entire length of the cylinder assembly. As clearly shown in FIGS. 1 and 2, the center dam connection 15 includes a center gland or dam 16 which is desirably made out of a relatively light weight metal such as aluminum. The center dam 16 has a central opening 17 therethrough for the output rod 8, with suitable seals therebetween.

The cylinder barrels 2, 3 are of a composite construction as aforesaid, including, for example, plural layers of circumferential or hoop stress windings 18 surrounded by compressive cylinder composite windings 19 and longitudinal tension windings 20. All of such windings may be made of a suitable composite fiber such as a high modulus graphite filament wound fiber impregnated with a suitable resin such as epoxy, polyester, polyamide, etc.

The hoop stress windings 18 carry the hoop loads and prevent diametrical expansion of the fluid cylinders when high pressure fluid is admitted to either end of the respective chambers 4, 5 during extension and retraction of the rod 8, whereas the compressive cylinder composite windings 19 may be wound from low angle helical fibers for transmitting compression loads between the center dam 16 and end glands 21, 22 at opposite ends of the assembly. The longitudinal tension windings 20 may also be wound on a bias, and transmit tension loads from one end of each cylinder to the other.

The inner diameter (I.D.) of each cylinder barrel 4, 5 may be lined with an impermeable inner barrier liner member 25 to prevent fluid seepage through the relatively porous composite material of the respective cylinder side walls. Such liner members may be fabricated from metal or organic materials, and if organic materials are used, such materials may either be applied as a coating on the I.D. of the cylinders, or the inner wall of the cylinders may be impregnated with such materials.

The end gland 22 is attached to the outboard end of the rod end cylinder 3 and has a central opening 26 therein through which the rod 8 extends, with suitable seals therebetween. The outboard end of the liner member 25 surrounding the rod end chamber 5 and hoop stress windings 18 thereabout extend over a portion of the exterior length of the end gland 22, with suitable seals between the end gland and liner member. The rod end gland 22 may be retained at the outboard end of the rod end cylinder as by means of a metal end ring 27 attached to the metal end gland 22 in any suitable manner, for example, by a threaded connection or by means of a retaining wire 28 as shown.

The retaining wire 28 may be removed by unscrewing a nut 29 in the outer end of the end gland 22 and removing an end plate 30 which prevents the end gland 22 from being drawn into the rod end chamber 5 during retraction of the rod 8. The end plate 30 may include a retract pressure port (not shown) which communicates with the rod end retract chamber through a passage in the end gland. Removal of the retaining wire 28 permits removal of the metal end gland 22 for changing the seals, etc.

The end ring 27 is desirably secured to the rod end cylinder 3 as by providing an external tapered surface 35 thereon facing outwardly of the rod end which is engaged by the outboard ends of the respective longitudinal tension windings 20 and attached thereto as by means of circumferential windings 18 interspersed between each layer of longitudinal tension windings 20 at the outboard ends thereof as shown in FIG. 1. The rod end gland 22 (including the end ring 27) also has a shoulder 36 which extends slightly radially outwardly beyond the adjacent end of the rod end liner member 25 and surrounding circumferential windings 18 to provide a reaction surface for engagement by one end of the compressive cylinder composite windings 19 wound on the outside of the circumferential windings.

At the inboard end of the head end cylinder 2 is the end gland 21 which provides a closure for the head end chamber 4. The head end gland 21 may also include suitable porting (not shown) to the head end extend chamber. Adjacent the outboard end of the head end gland 21 is an external cylindrical surface 40 over which the inboard end of the liner member 25 that surrounds the head end chamber 2 and circumferential windings 18 wrapped therearound extend, with suitable seals between such liner member and head end gland. A shoulder 42 extends radially outwardly from the cylindrical surface 40 beyond the adjacent end of the head end liner 25 and surrounding circumferential windings 18 to provide a reaction surface for engagement by one end of the respective compressive cylinder composite windings 19. The head end gland 21 may be secured in place at the inboard end of the head end cylinder as by providing an external tapered surface 43 on the head end gland facing away from the rod end which is engaged by the inboard ends of the respective longitudinal tension windings 20 and attached thereto as by means of circumferential windings 18 interspersed between the layers of longitudinal tension windings, similar to the connection between the rod end gland and rod end cylinder previously described.

At the adjacent ends of the head and rod end cylinder barrels 2, 3 are external ramp surfaces 50, 51 thereon which face in opposite directions away from each other to facilitate attachment of such ends to the center dam 16 as described hereafter. The external ramp surfaces 50, 51 are desirably formed by interspersing circumferential windings 18 between the longitudinal tension fibers 20 at the adjacent ends thereof to displace the longitudinal tension fibers radially outward and add circumferential stiffness to such ends. Before connecting such ends together, the cylinder barrels 2, 3, including the respective head and rod end glands 21, 22 and respective windings 18, 19, 20 with external ramp surfaces 50, 51 at the respective outboard and inboard ends thereof are placed in an oven and heated to a temperature sufficient to cause the windings to bond together.

To connect the head and rod end cylinders 2, 3 together, first the adjacent ends of the head and rod end cylinders are slipped over cylindrical surfaces 52, 53 at opposite ends of the center dam 16 and up against an external annular flange 54 intermediate the ends of the center dam. Suitable seals 55 may be provided between the center gland and each liner member 25 of the respective cylinders to prevent fluid leakage therebetween. Also, the opposite sides 56, 57 of the annular flange 54 on the center dam 16 and adjacent end faces 58, 59 of the external ramp surfaces 50, 51 on the cylinder barrels are desirably generally flat and parallel to each other, and such flange sides 56, 57 desirably extend generally radially outwardly substantially perpendicular to the longitudinal axis of the cylinder assembly 1 over substantially the full radial extent of the ramp end faces to provide substantially full surface contact therebetween.

Then annular clamping rings 60, 61 are placed up against the external ramp surfaces 50, 51 on the cylinder barrels and connected together as by means of a plurality of bolts 62 extending through the clamping rings and attached thereto as by means of nuts 63. The clamping rings 60, 61 have internal ramp surfaces 65, 66 of substantially the same slope as the respective external ramp surfaces 50, 51 on the cylinder barrels for wedging engagement thereagainst. Accordingly, upon tightening the nuts 63, the bolts 62 are pretensioned to force the clamping rings 60, 61 toward each other, which in turn results in a compression load being applied at the ramp surfaces 50, 51 to force the adjacent end faces of the composite cylinder barrels against opposite sides of the center dam flange 54.

Alternatively, the joint between the center dam 16 and adjacent ends of the head and rod end cylinder barrels 2, 3 may be pretensioned by using in place of the bolts 62, a tensioning nut 70 having internal threads 71, 72 of opposite hand in opposite ends of the nut in threaded engagement with external threads 73, 74 on the clamping rings 75, 76 as shown in FIG. 5. However, the use of such a tensioning nut would not be practical if fluid is ported to the outboard and inboard ends of the respective head and rod end chambers through passages 77, 78 in the center dam 16 as schematically shown in FIGS. 1 and 2.

In the event that it should become necessary to slip one of the clamping rings over the respective cylinder from the external ramped end thereof or over a large diameter surface having for example an O.D. equal to or greater than the O.D. of the external ramp ends, split spacers 80 or 80' may be inserted between the respective clamping ring 81 or 75 and external ramp surface, for example, ramp surface 50 as shown in FIGS. 3–5, to permit the I.D. of the clamping ring 81 or 75 to be increased to clear the O.D. of the external ramp surface or other larger diameter surface. In that event, internal ramp surfaces 82 are provided on the split spacers 80 or 80' rather than on the associated clamping ring 81 or 75. Also, the split spacers 80 or 80' are provided with a stepped external shoulder 83 or 83' for engagement by a correspondingly shaped internal stepped shoulder 84 on the I.D. of the clamping ring 81 or 75. Otherwise, the details of construction and operation of the clamping connection between the adjacent ends of the cylinder barrels of the FIGS. 3 and 5 embodiments are substantially the same as that shown in the FIGS. 1 and 2 embodiment. Accordingly, the same reference numerals are used to designate like parts.

From the foregoing, it will not be apparent that the dual tandem composite cylinder assemblies of the present invention provide a simple and effective means for connecting the head and rod end cylinder barrels together at a center dam connection by forcing the ends of the tension fibers of both cylinder barrels against the center dam by a compression load applied to ramp surfaces at the adjacent ends of the cylinder barrels. With such a construction, tension on the longitudinal tension fibers is reacted by a relaxation of compression between the fibers and the center dam and increased compression on the ramp surfaces.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A dual tandem composite cylinder assembly comprising a pair of composite cylinder barrels in series, end wall members at the ends of said cylinder barrels furthest from each other and a center gland between adjacent ends of said cylinder barrels, said cylinder barrels having cylindrical inner walls extending the entire length of said cylinder barrels and outwardly sloping external ramp surfaces at the adjacent ends of said cylinder barrels facing in opposite directions away from each other, and clamping means for wedging said external ramp surfaces into clamping engagement with said center gland.

2. The assembly of claim 1 wherein said clamping means comprises a clamping ring for each ramp surface, and means for urging said clamping rings toward each other to force said ramp surfaces against said center gland.

3. The assembly of claim 2 wherein at least one of said clamping rings has an internal ramp surface of substantially the same slope as one of said external ramp surfaces for wedding engagement of said one clamping ring with said one external ramp surface to force said one external ramp surface against said center gland.

4. The assembly of claim 3 wherein both of said clamping rings have internal ramp surfaces of substantially the same slope as said external ramp surfaces for wedging engagement of said clamping rings with said external ramp surfaces to force said external ramp surfaces against said center gland.

5. The assembly of claim 2 wherein said center gland has external flange means extending radially outwardly between the adjacent ends of said cylinder barrels against which said external ramp surfaces are clamped by said clamping means.

6. The assembly of claim 5 wherein said center gland has external cylindrical surfaces at opposite ends of said center gland over which the cylindrical inner walls at the adjacent ends of said cylinder barrels extend into engagement with opposite sides of said external flange means.

7. The assembly of claim 5 wherein said external flange means has oppositely facing, radially extending sides that are substantially flat and parallel to each other, and said external ramp surfaces have opposed end faces that are substantially flat and parallel to each other and to said opposite sides of said external flange means.

8. The assembly of claim 7 wherein the opposite sides of said external flange means and the adjacent end faces of said external ramp surfaces extend radially outwardly in a direction generally perpendicular to the longitudinal axis of said cylinder assembly.

9. The assembly of claim 8 wherein the opposite sides of said external flange means extend substantially the full radial extent of the end faces of said external ramp surfaces to provide substantially full surface contact therebetween.

10. The assembly of claim 2 wherein said means for urging said clamping rings toward opposite sides of said center gland comprises bolt means extending between said clamping rings.

11. The assembly of claim 2 wherein said means for urging said clamping rings toward opposite sides of said center gland comprises a tensioning nut having internal threads of opposite hand at opposite ends of said tensioning nut, and said clamping rings are externally threaded for threaded engagement with the oppositely threaded ends of said tensioning nut.

12. The assembly of claim 2 wherein at least one of said clamping rings has an inner diameter greater than the outer diameter of said external ramp surfaces to permit said one clamping ring to freely pass over said external ramp surfaces during assembly of said one clamping ring onto said cylinder assembly, and force transferring means are provided for transferring a clamping force that is applied to said one clamping ring to one of said external ramp surfaces to force said one external ramp surface against said center gland.

13. The assembly of claim 12 wherein said force transferring means comprises a plurality of split spacers inserted between said one clamping ring and said one external ramp surface.

14. The assembly of claim 13 wherein said split spacers have internal ramp surfaces of substantially the same slope as said one external ramp surface for wedging engagement of said split spacers against said one external ramp surface when a clamping force is applied to said one clamping ring.

15. The assembly of claim 14 wherein said one clamping ring and said split spacers have radially overlapping surfaces to provide for the transfer of forces from said one clamping ring to said split spacers.

16. The assembly of claim 1 wherein each of said cylinder barrels comprises plural layers of longitudinal and circumferential fibers, and said ramp surfaces are formed by interspersing additional circumferential fibers between the longitudinal fibers at the adjacent ends of said cylinder barrels to displace said longitudinal fibers radially outwardly away from said cylindrical inner walls at said adjacent ends and add circumferential stiffness to said adjacent ends.

17. A dual tandem composite cylinder assembly comprising a pair of composite cylinder barrels in series, end wall members at the ends of said cylinder barrels furthest from each other and a center gland between adjacent ends of said cylinder barrels, said cylinder barrels having cylindrical inner walls over the entire length of said cylinder barrels and outwardly sloping external ramp surfaces at the adjacent ends of said cylinder barrels facing in opposite directions away from each other, and clamping means for wedging said external ramp surfaces into clamping engagement with said center gland, each of said cylinder barrels comprising plural layers of longitudinal and circumferential fibers, and said ramp surfaces being formed by interspersing additional circumferential fibers between the longitudinal fibers at the adjacent ends of said cylinder barrels to displace said longitudinal fibers radially outwardly away from said cylindrical inner walls at said adjacent ends and add circumferential stiffness to said adjacent ends, said clamping means comprising a clamping ring for each ramp surface, and means for urging said clamping rings toward each other to force said ramp surfaces against said center gland, said center gland having external flange means extending radially outwardly between the adjacent ends of said cylinder barrels against which opposed end faces of said external ramp surfaces are clamped by said clamping means.

18. The assembly of claim 17 wherein said center gland has external cylindrical surfaces at opposite ends of said center gland over which the cylindrical inner walls at the adjacent ends of said cylinder barrels extend into engagement with opposite sides of said external flange means.

19. The assembly of claim 18 wherein said external flange means has oppositely facing, radially extending sides that are substantially flat and parallel to each other, and said opposed end faces of said external ramp surfaces are substantially flat and parallel to each other and to said oppositely facing sides of said external flange means, said oppositely facing sides of said external flange means and said opposed end faces of said external ramp surfaces extending radially outwardly in a direction generally perpendicular to the longitudinal axis of said cylinder assembly.

20. The assembly of claim 19 wherein said clamping rings have internal ramp surfaces of substantially the same slope as said external ramp surfaces for wedging engagement of said clamping rings with said external ramp surfaces to force said external ramp surfaces against said external cylindrical surfaces of said center gland and said oppositely facing sides of said external flange means.

* * * * *